US007172516B2

(12) United States Patent
Wu

(10) Patent No.: US 7,172,516 B2
(45) Date of Patent: Feb. 6, 2007

(54) DIRECTIONAL PRACTICE DEVICE

(76) Inventor: Victor Chun-Cheng Wu, No. 269, Sec. 5, Nanjing E. Rd., Songshan District, Taipei City 105 (TW)

( * ) Notice: Subject to any disclaimer, the term of this patent is extended or adjusted under 35 U.S.C. 154(b) by 0 days.

(21) Appl. No.: 11/271,793

(22) Filed: Nov. 14, 2005

(65) Prior Publication Data

US 2006/0148583 A1 Jul. 6, 2006

Related U.S. Application Data

(63) Continuation-in-part of application No. 11/028,523, filed on Jan. 5, 2005, now abandoned.

(51) Int. Cl.
*A63B 69/36* (2006.01)

(52) U.S. Cl. ..... 473/264; 473/219; 473/226; 473/229; 473/260

(58) Field of Classification Search ..... 473/219, 473/226, 229, 257, 258, 260, 261, 262, 264, 473/265

See application file for complete search history.

(56) References Cited

U.S. PATENT DOCUMENTS

| | | | | |
|---|---|---|---|---|
| 2,084,901 | A * | 6/1937 | Eisenberg | 473/229 |
| 2,084,902 | A * | 6/1937 | Eisenberg | 473/229 |
| 2,894,755 | A * | 7/1959 | Scelzo, Jr. | 473/265 |
| 3,246,898 | A * | 4/1966 | Shoaf, Jr. | 473/265 |
| 3,471,155 | A * | 10/1969 | Donaldson | 473/260 |
| 5,437,458 | A * | 8/1995 | Springer | 473/229 |
| 6,837,802 | B1 * | 1/2005 | Santamaria | 473/258 |
| 6,840,870 | B1 * | 1/2005 | Froggatte | 473/265 |

* cited by examiner

*Primary Examiner*—Nini F. Legesse
(74) *Attorney, Agent, or Firm*—Troxell Law Office PLLC

(57) ABSTRACT

A directional practice device includes a directional frame and a rail base. The directional frame provides a part being defined to move rectilinearly and an engaging member for locating a sport apparatus. The rail base provides two parallel rail parts and each of the rail parts has a component to define a movement of the directional frame.

6 Claims, 4 Drawing Sheets

DIRECTIONAL PRACTICE DEVICE

The present invention is a Continuation-In-Part of U.S. application Ser. No. 11/028,523, filed on Jan. 5, 2005 and currently abandoned.

FIELD OF THE INVENTION

The present invention relates to a directional practice device and particularly to a disciplining device, which is available for the user to practice rectilinear movement and enhance steadiness of the movement.

BACKGROUND OF THE INVENTION

To pursue accurate rectilinear movement is frequently seen in sports such as basketball, billiard, golf and etc. and preciseness completely depends on if the movement is accurate. A common feature of these sports is that the direction of the movement is initialed with a little deviation results in a great inaccuracy of the movement.

Taking the golf as an example, when the player pushes the golf ball into the hole, it is required to move rectilinearly toward the hole so that how to allow the ball moving toward orientation of hole and entering the hole is subject the player has to practice. For a new learner, it is necessary to learn a posture of holding the club with a movement along the same direction without deviation. It is an important factor that the learner has to control steadiness of direction during hands moving the club.

In addition, it is known that skill comes from practice and movements of human body can reach least mistake through practicing repeatedly. Little movement like reckoning by abacus or playing musical instruments with fingers and large movement like moving the whole hand or leg need to practice repeatedly in order to obtain the accuracy. Hence, the movement keeping in the same direction while the club has to be practiced repeatedly, otherwise it is hard to adjust error effectively and the progress through practice is very little.

SUMMARY OF THE INVENTION

An object of the present invention is to provide a directional practice device to assist the learner experiencing how to control steadiness of moving rectilinearly.

Accordingly, the directional practice device according to the present invention includes a directional frame and a rail base. The directional frame provides a part being defined to move rectilinearly and an engaging member for locating a sport apparatus. The rail base provides two parallel rail parts and each of the rail parts has a component to define a movement of the directional frame.

BRIEF DESCRIPTION OF THE DRAWINGS

The present invention can be more fully understood by reference to the following description and accompanying drawings, in which.

DETAILED DESCRIPTION OF THE INVENTION

Figure 1:
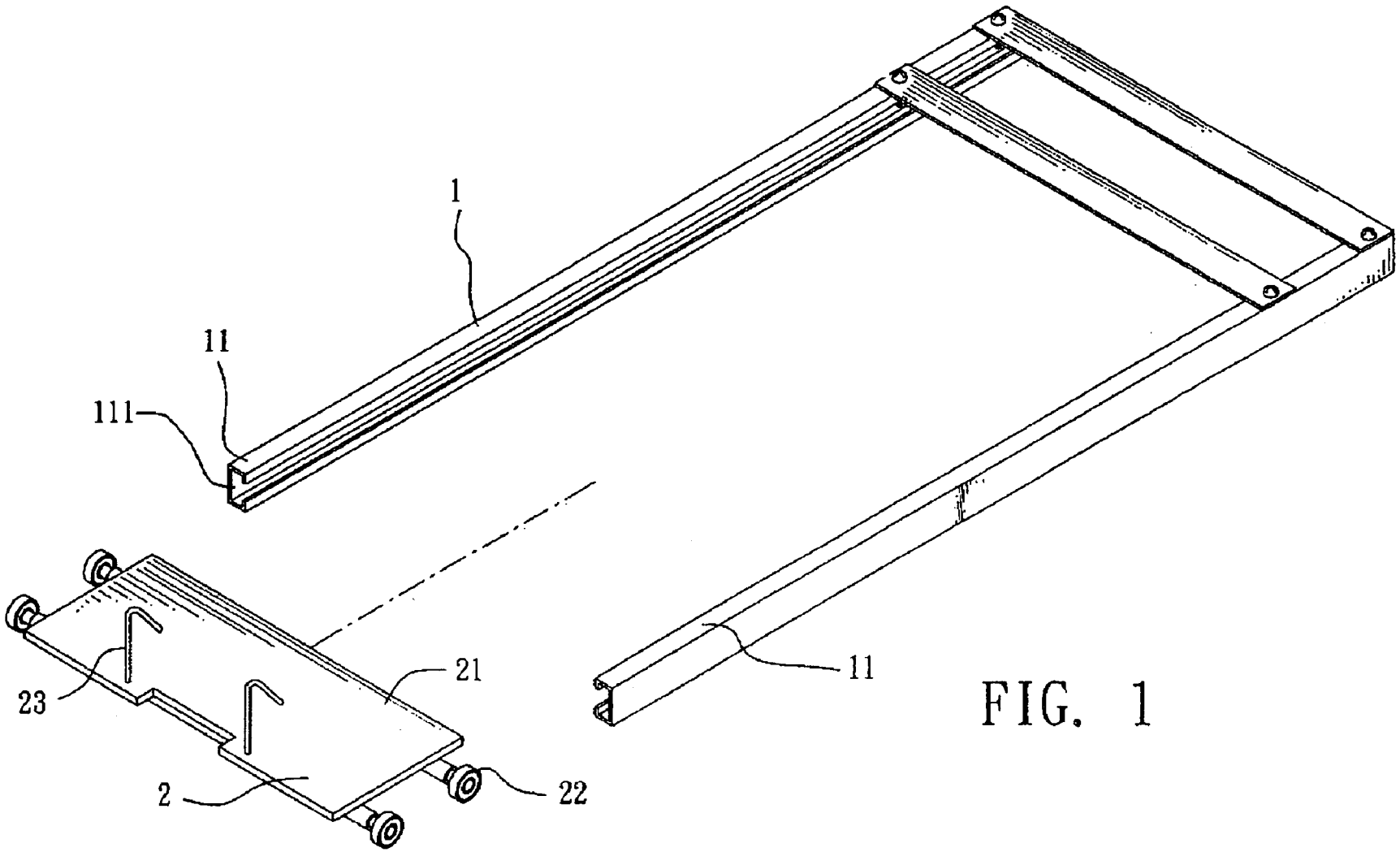
FIG. 1 is an exploded perspective view of a preferred embodiment of a directional practice device according to the present invention.
Figure 2:
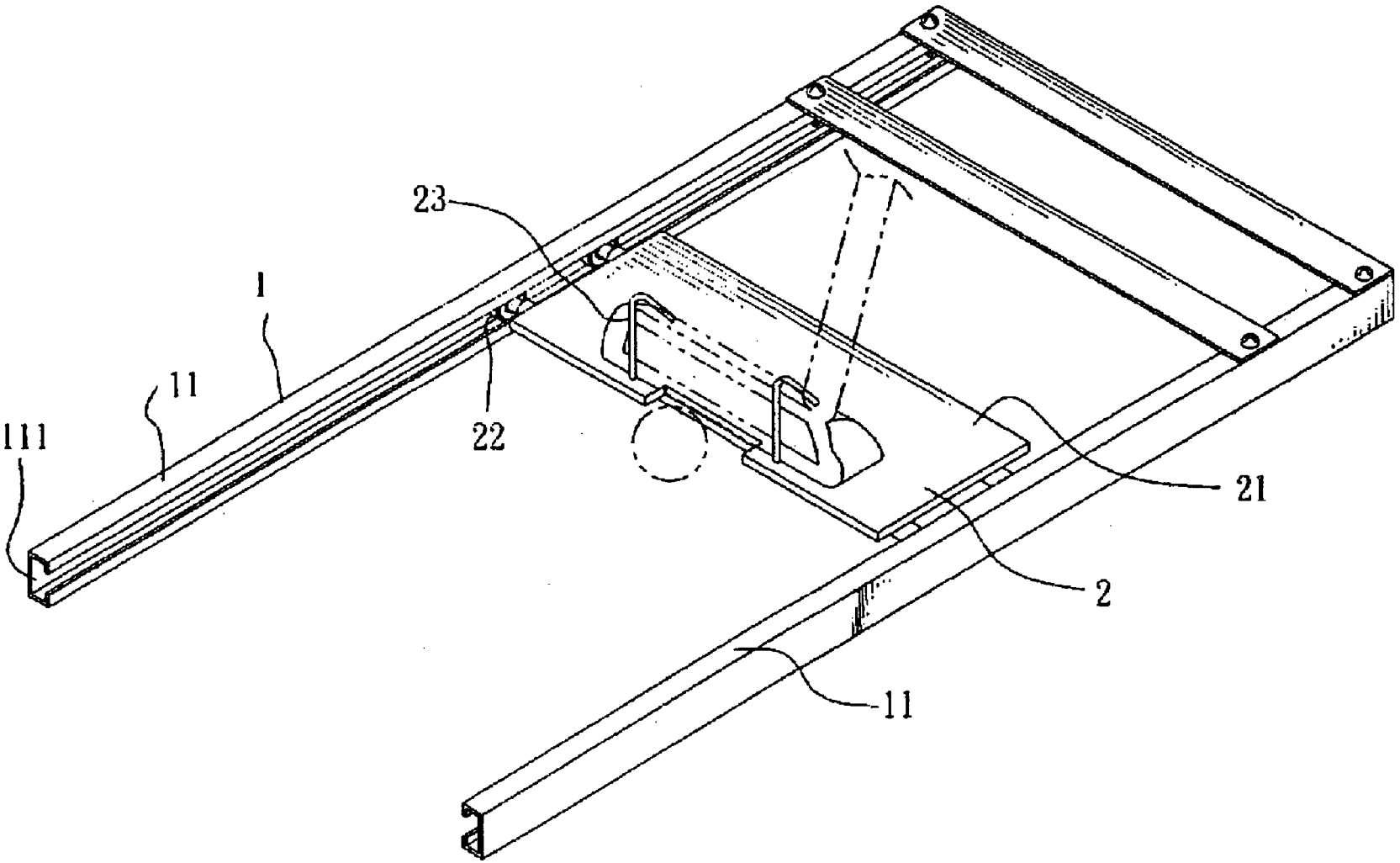
FIG. 2 is an assembled perspective view of a preferred embodiment of a directional practice device according to the present invention shown in FIG. 1.

Referring to FIGS. 1 and 2, a directional practice device according to the present invention comprises a rail base 1 and a directional frame 2.

Wherein, the rail base 1 is available for the directional frame 2 sliding along so that the rail base 1 has two straight rail parts 11 parallel to each other. A rail groove 111 is provided in each of the rail parts 11 and the rail groove 111 is a channel recess in the present embodiment. It is noted that the channel recess is only an example type of the rail groove 111 and not a limitation.

The directional frame 2 provides a width corresponding to the rail base 1 and has a plate shaped frame seat 21 with at least a movable projection 22 at two lateral sides thereof corresponding to the rail grooves 111. The projection 22 can be an outward projecting piece or a roller with a bearing. There are two projections 22 at each lateral side of the frame seat 21 in the embodiment of the present invention.

Besides, in order to allow a sport apparatus such as a club being able to be secured to the frame seat 21, an engaging member 23 is provided on the frame seat 21. The engaging member 23 is provided with two hooked pieces for locating the club in the embodiment. For the billiard stick, it can be provided with only a hook piece as the engaging member 23 for being inserted with stick. In fact, it can be different types of engaging member 23 in use such as Velcro band can be provided on the frame seat 21. Basically, it is an essential requirement that the engaging member 23 is capable of locating a certain part of the sports apparatus.

Referring to FIGS. 1 and 2 again, the directional frame 2 can be slidably attached to the rail base 11 by way of the projections 22 being inserted into the rail grooves 111. Meanwhile, in case of the related part of a sport apparatus such as the club head being able to be located at the engaging member 23, the learner can move the sport apparatus repeatedly and allows the sport apparatus performing rectilinear movement constantly. In this way, the learner can practice the same movement along the same orientation skillfully such that the steadiness and accuracy of the movement done by the learner can be enhanced largely.

Figure 3:
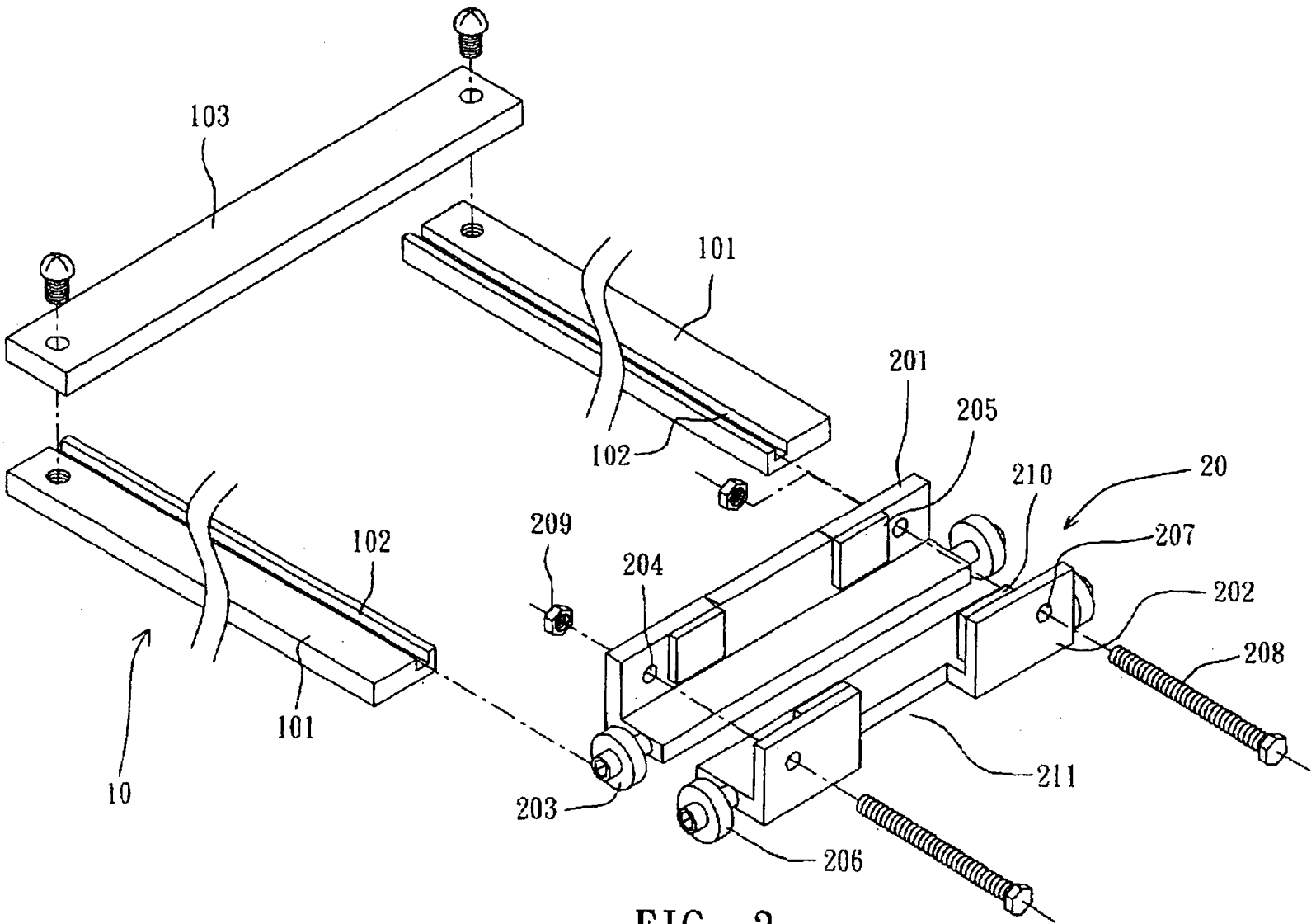
FIG. 3 is the explored perspecgive view showing the second embodiment.
Figure 4:
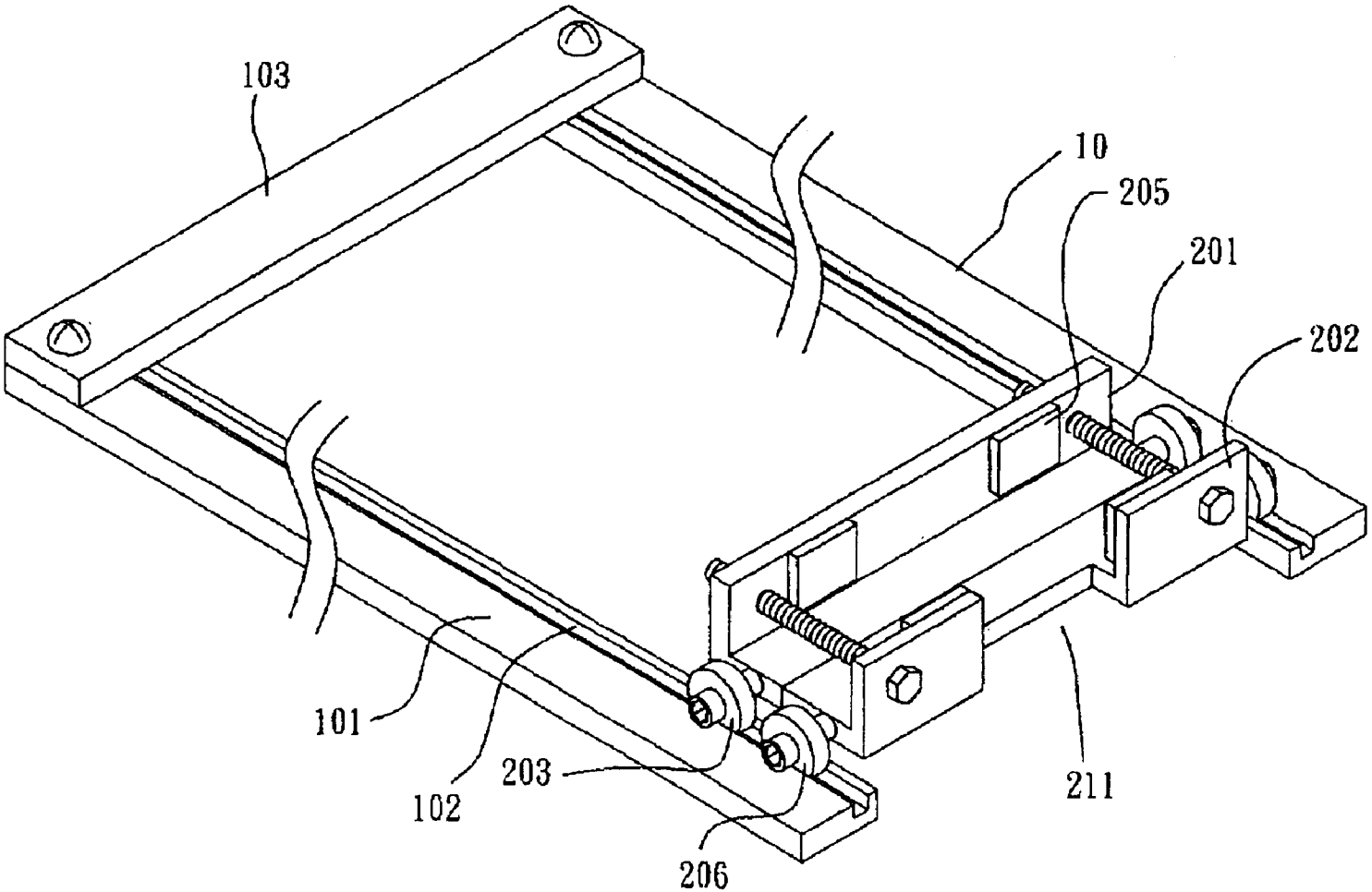
FIG. 4 is the assembled perspective view showing the second embodiment.

FIGS. 3 and 4 show an alternate form of the directional practice device. As shown in FIG. 3, the directional practice device according to this embodiment is also comprised of a rail base 10 and a directional frame 20.

The rail base 10 comprises two rails 101 each defining a longitudinally extending rail groove 102, and a locating bar 103, which joins the rails 101 to hold the rail grooves 102 in parallel. The locating bar 103 can be fixedly fastened to the rails 10. Alternatively, the locating bar 103 can be detachably fastened to the rails 101 with screws or other fastening means. For example, the rails 101 each can be made having a screw hole near one end: the locating bar 103 can be made having two mounting through holes respectively fastened to the screw holes of the rails 101 with a respective screw.

The directional frame 20 comprises an inner frame bar 201 and an outer frame bar 202. The inner frame bar 201 and the outer frame bar 202 are angle bars arranged in parallel and facing each other. The inner frame bar 201 has two rollers 203 respectively pivotally provided at the two distal ends thereof, two locating holes 204 disposed near the two distal ends, and soft pads 205 fixedly provided at the vertical wall thereof at an inner side. The outer frame bar 202 has two rollers 206 respectively pivotally provided at the two distal ends thereof, two locating holes 207 disposed near the two distal ends corresponding to the locating holes 204 of the inner frame bar 201, and soft pads 210 fixedly provided at the vertical wall thereof at an inner side corresponding to the soft pads 205 at the inner frame bar 201. According to this embodiment, the locating holes 207 are screw holes. Further, two screws 208 are respectively mounted in the locating holes 207 of the outer frame bar 202 and the locating holes 204 of the inner frame bar 201 and then screwed up with a respective nut 209 to secure the inner frame bar 201 and the outer frame bar 202 together. Further, the outer frame bar 202 has an opening 211 for practicing the action of ball-putting. The inner frame bar 201 may be made having a corresponding opening for practicing the action of ball-putting.

Referring to FIG. 4 again, the locating bar 103 is affixed to the rails 10 to hold the rails 10 in parallel, and then the rollers 203 of the inner frame bar 201 and the rollers 206 of the outer frame bar 202 are respectively coupled to the rail grooves 102 of the rails 101, and then the screws 208 are respectively mounted in the locating holes 207 of the outer frame bar 202 and the locating holes 204 of the inner frame bar 201 and respectively screwed up with the nuts 209 to secure the inner frame bar 201 and the outer frame bar 202 together. During practice the club head is set in between the inner frame bar 201 and the outer frame bar 202. Further, the nuts 209 can be eliminated when the locating holes 204 are made in the form of a screw hole.

The aforesaid second embodiment is also detachable and convenient to carry. Further, the rails may be provided with mounting holes for the mounting of nails or the like to anchor the rail base to the artificial lawn.

It is appreciated that although the directional practice device of the present invention is used in a very limited space instead of practicing at the real playing field, effective and steady practice can be obtained as well. Further, it is very easy to set up and to operate the directional practice device of the present invention. These advantages are not possible to achieve with the prior art.

While the invention has been described with reference to the a preferred embodiment thereof, it is to be understood that modifications or variations may be easily made without departing from the spirit of this invention, which is defined by the appended claims.

What the invention claimed is:

1. A directional practice device comprising:

two rails arranged in parallel, said rails each having a longitudinal groove extending between two distal ends thereof;

a locating bar fastened to one end of each of said rails to hold said rails in parallel;

an inner angle bar and an outer angle bar arranged in parallel and facing each other, said inner angle bar and said outer angle bar each having two locating holes respectively disposed near two distal ends thereof, said outer angle bar having an opening for practicing the action of ball-putting;

two pairs of rollers respectively pivotally provided at two distal ends of each of said angle bars and respectively coupled to the longitudinal grooves of said rails to guide movement of said angle bars along said rails; and two screws respectively mounted in the locating holes of said angle bars to join said angle bars.

2. The directional practice device as claimed in claim 1, further comprising two nuts respectively threaded onto said screws.

3. The directional practice device as claimed in claim 1, wherein the locating holes of said inner angle bar and said outer angle bar are screw holes.

4. The directional practice device as claimed in claim 1, wherein said inner angle bar and said outer angle bar each have a vertical wall and a plurality of soft pads provided at the respective vertical wall.

5. The directional practice device as claimed in claim 1, wherein said rails each have a screw hole near one end; said locating bar has two mounting through holes respectively fastened to the screw holes of said rails with a respective screw.

6. The directional practice device as claimed in claim 1, wherein said inner angle bar has an opening corresponding to the opening at said outer angle bar.

* * * * *